US008196525B2

(12) United States Patent
Flanet

(10) Patent No.: US 8,196,525 B2
(45) Date of Patent: Jun. 12, 2012

(54) LEG ASSEMBLY FOR A TABLE OR DESK WITH HOOKING MEANS AND DESK PROVIDED WITH THESE LEG ASSEMBLIES

(75) Inventor: Daniel Flanet, Schiltigheim (FR)

(73) Assignee: Steelcase SA, Schiltigheim (FR)

( * ) Notice: Subject to any disclaimer, the term of this patent is extended or adjusted under 35 U.S.C. 154(b) by 641 days.

(21) Appl. No.: 12/292,669

(22) Filed: Nov. 24, 2008

(65) Prior Publication Data

US 2009/0145342 A1 Jun. 11, 2009

(30) Foreign Application Priority Data

Nov. 23, 2007 (EP) ..... 07360058

(51) Int. Cl.
*A47B 41/04* (2006.01)

(52) U.S. Cl. ..... 108/28; 108/50.02; 248/188.8

(58) Field of Classification Search ..... 108/155, 108/50.11, 50.01, 50.02, 147.19, 28, 30; 248/235, 225.21, 224.8, 250, 188.8; 211/106.01, 211/193, 192, 182
See application file for complete search history.

(56) References Cited

U.S. PATENT DOCUMENTS 110,239 A * 12/1870 Hutchinson ..... 211/106.01
752,203 A * 2/1904 Cook ..... 211/106.01
2,060,760 A * 11/1936 Keil ..... 211/106.01
2,619,166 A * 11/1952 Graber ..... 160/344
2,964,202 A * 12/1960 Gingher et al. ..... 108/30
3,137,890 A * 6/1964 Kochanowski ..... 16/87.2
3,695,569 A * 10/1972 Pullan ..... 248/235
4,768,660 A * 9/1988 Handler et al. ..... 211/106.01
4,799,643 A * 1/1989 Shepard ..... 248/544
5,310,148 A * 5/1994 Dorr ..... 248/223.41
5,358,323 A * 10/1994 Ripley ..... 312/228
5,388,663 A * 2/1995 Phillippe et al. ..... 182/82
5,758,851 A * 6/1998 Remmers ..... 248/251
5,931,488 A * 8/1999 Graziano et al. ..... 280/639
6,047,838 A * 4/2000 Rindoks et al. ..... 211/187
6,053,465 A * 4/2000 Kluge ..... 248/235
6,146,046 A * 11/2000 Oberle ..... 403/170
6,336,414 B1 * 1/2002 Stewart et al. ..... 108/50.02
6,345,579 B1 * 2/2002 Zaturensky ..... 108/152
6,682,030 B2 * 1/2004 Santoro et al. ..... 248/188.5
7,137,515 B1 * 11/2006 Lawson et al. ..... 211/85.3
2010/0051770 A1 * 3/2010 Liang ..... 248/250

FOREIGN PATENT DOCUMENTS

DE 3828788 A1 * 3/1990
DE 201 06 396 U1 9/2001

* cited by examiner

*Primary Examiner* — Darnell Jayne
*Assistant Examiner* — Andres F Gallego
(74) *Attorney, Agent, or Firm* — Oliff & Berridge, PLC

(57) ABSTRACT

A leg assembly for a table and notably for a desk includes
a base resting on the ground,
shaft with a vertical appearance, attached to the base, and
an upper sole surmounting the shaft and provided for supporting a platform.
The sole has a hook positioned at a free end of the sole localized in the vicinity of a border of the platform.

10 Claims, 5 Drawing Sheets

LEG ASSEMBLY FOR A TABLE OR DESK WITH HOOKING MEANS AND DESK PROVIDED WITH THESE LEG ASSEMBLIES

The present invention relates to a leg assembly for a table, notably for a desk, as well as to a desk provided with such a leg assembly.

The relevant leg assembly includes essentially:

a base resting on the ground;

a cylindrical shaft with a vertical appearance, attached to the base; and an upper sole surmounting the shaft and provided for supporting a platform.

The table or desk formed from such leg assemblies in its simplified version has at least two leg assemblies supporting a platform forming, for example in the case of a desk, a work top.

The primary mission of a piece of furniture of the table or desk type is to provide the user with a stable work top for working. In applications in the field of office furniture, many components or complementary modules may be added to the component consisting in its simplest expression of a platform and of at least two leg assemblies: for example these may be storage boxes, panels for separating spaces, lighting components, additional platforms for supporting the everyday tools which computers, keyboards, etc. have become.

From an optimization, or even user-friendliness improvement view point, in the everyday use of tables or desks, the logic of present development is focused in the direction of adding functions which go beyond strict office automation needs. It is thus possible to provide attachment of more personal components such as supports of accessories on or under the platform, the application of which is left to be freely selected by the user.

This is notably the object of the present invention.

Essentially, said invention is characterized in that the sole of a leg assembly for a table or for a desk has hooking means, positioned at a free end localized in the vicinity of a border of the platform.

Thus, the user may have a possibility, which is practical in many everyday situations, of hooking up a document case, a bag or an umbrella, etc. The localization in the vicinity of the border of the platform simply aims at making the use easy and convenient of said hooking means.

Preferably, these hooking means consist in a hook placed in the extension of the sole.

As the sole spreads out substantially horizontally over a certain distance, its free end is therefore located not very far from a border of the platform. It is therefore of interest of placing the hook at this level. Further, said soles are oriented so that their free end is directed towards the location where the user is placed, at the front of the desk, in this case towards the seat on which he/she is sitting when he/she is at his/her work location.

In order to facilitate assembly, the hook is, preferably according to the invention, attached to the sole by clips. It is generally made in plastic, whereas the sole, belonging to the leg assembly is made in a pre-cut embossed folded metal sheet. These materials, notably making possible an elastic flexure of a connecting member from one to the other, are adapted to a connection by clips, which finally simplifies the work of the assemblers.

According to a possible layout, allowing the sole and the hook to be mounted to each other along such a connection:

the free end of the sole is axially adjusted in a recess in a side of the hook;

at least one tongue extending the upper surface of the sole is inserted into a through-slot made in the bottom of the recess;

said tongue includes a boss with a ramp tilted towards its free end, capable of elastically bending the tongue when it crosses the slot before its release when the sole comes and abuts at the bottom of the recess;

the surface of the tongue opposite to the one including the ramp, sliding in contact with a wall of the hook extending an edge of the slot, at least one side surface of the tongue being guided against a surface of the hook with the same orientation.

Several considerations aiming at establishing a stable connection are taken into account in this layout. Thus, the recess in a side of the hook enables the hook to be positioned/centered relatively to the sole. Moreover, the tongue(s) cooperate with a slot for an attachment by clips achieving axial attachment relatively to each other. The wall of the hook which extends the edge of the slot aims at preventing any parasitic rotary movement of the hook relatively to the sole, along an axis perpendicular to the axial orientation of the sole. Finally, the side guiding surface prevents any rotation along the axis of the sole.

The attachment of the hook to the sole is then firm and long-lasting.

According to one possibility, the free end of the sole includes two homologous parallel tongues. Both of these tongues include a tilted ramp as described earlier, and a double attachment by clips is achieved. Under this assumption, a tab jutting out from a border of the slot is inserted in between both tongues and achieves lateral guiding.

According to a possible layout, the hook includes a wall with a vertical appearance terminated by a wall with a vertical appearance which partly closes the aperture of the hook and allows articles of the bag, document-case, etc. type to be held naturally when they are hung therein.

The invention as mentioned earlier, also consists in a desk provided with leg assemblies such as described above.

In particular, it relates to a desk including:

a system of leg assemblies according to the preceding claims;

a work surface supported by said leg assembly system;

hooking means positioned in the upper portion of the leg assembly system in vicinity to the periphery of said system;

characterized in that the hooking means are localized at the border of the work surface when the latter is attached to the leg assembly system.

It will now be described in more detail, with reference to the appended drawings, for which:

Figure 4:
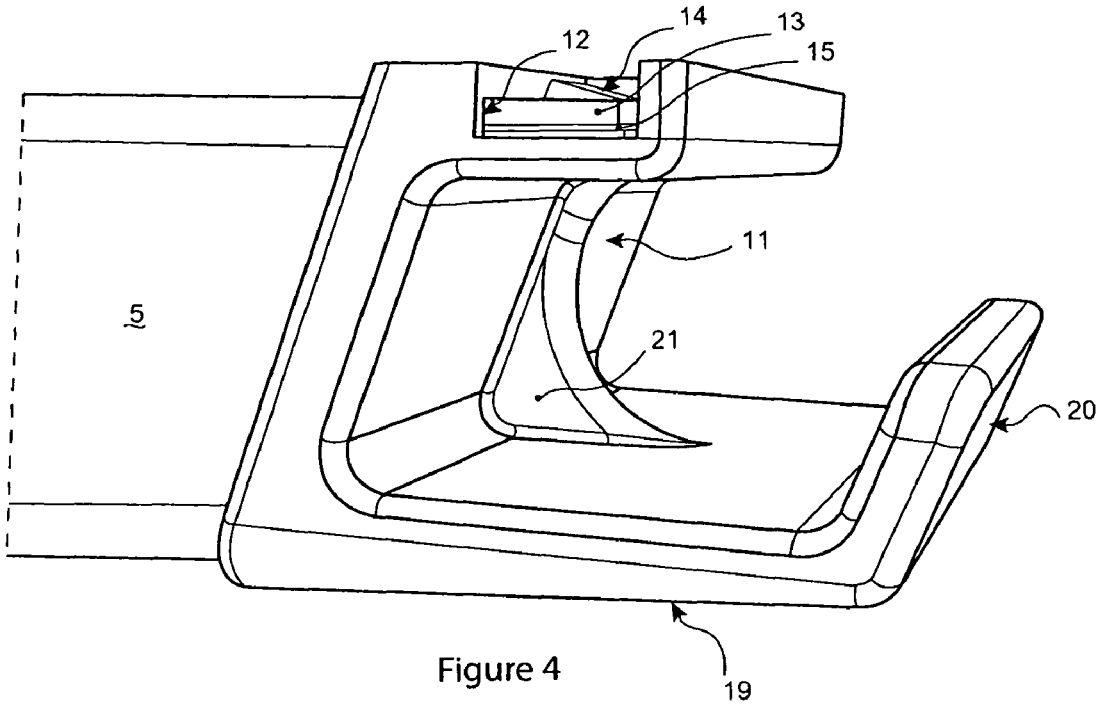
Figure 5:
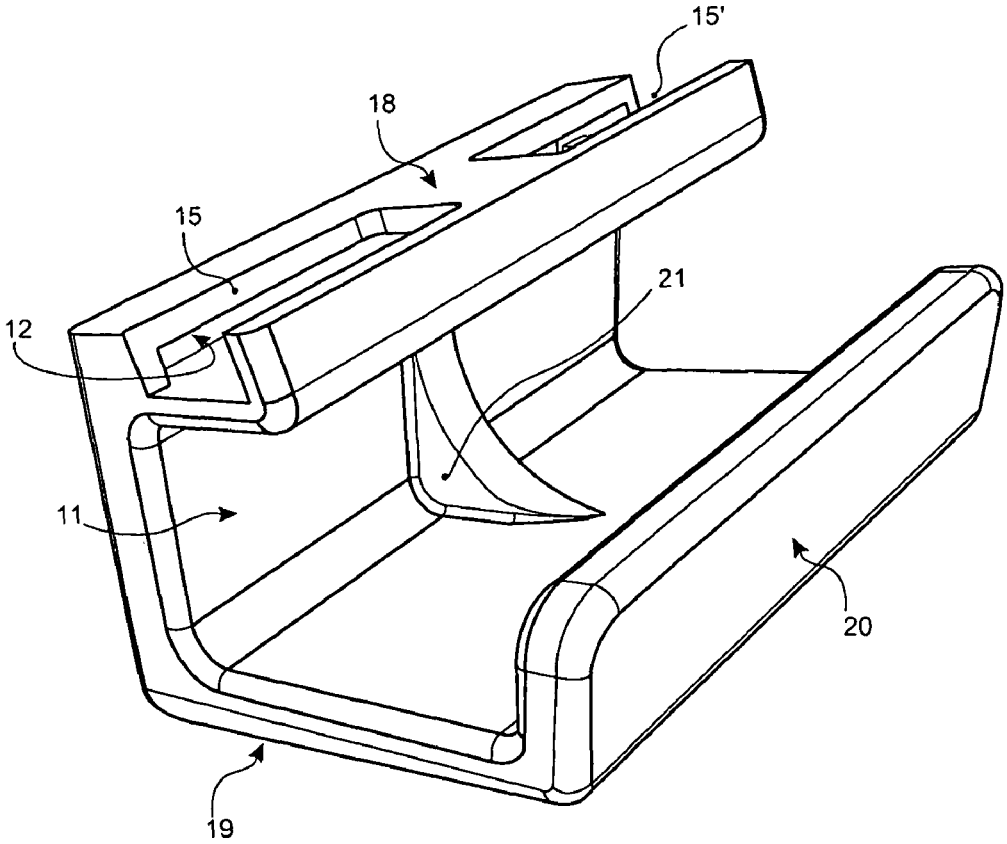

FIG. 4 in a perspective and detailed enlarged view, shows the connection between the free end of the sole and a hook according to the invention;

FIG. 5 is a perspective view of a single hook; and

Figure 6A:
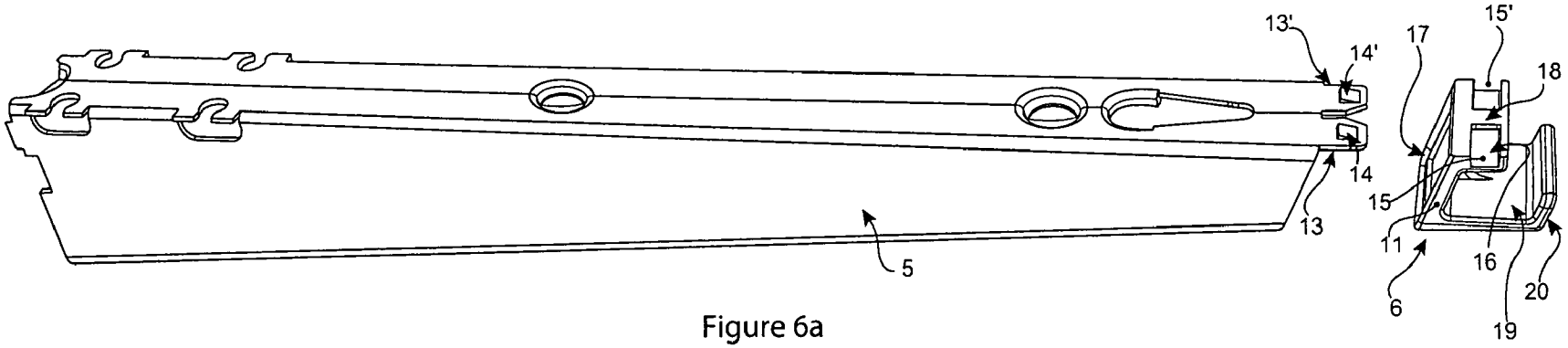
Figure 6B:
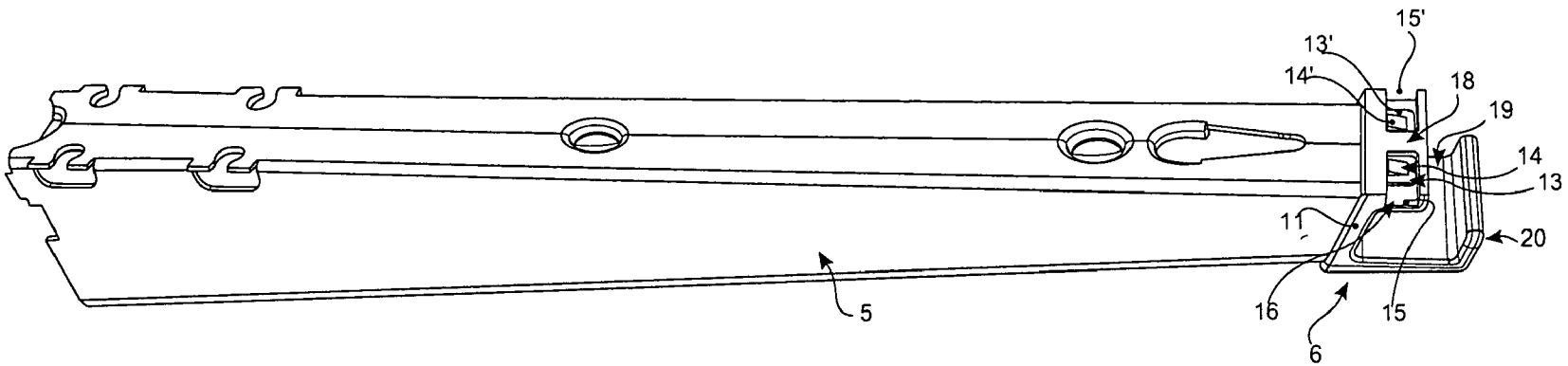

FIGS. 6*a* and 6*b* show the connecting mechanism between a sole and a hook, in the detached and connected layout respectively.

Figure 1:
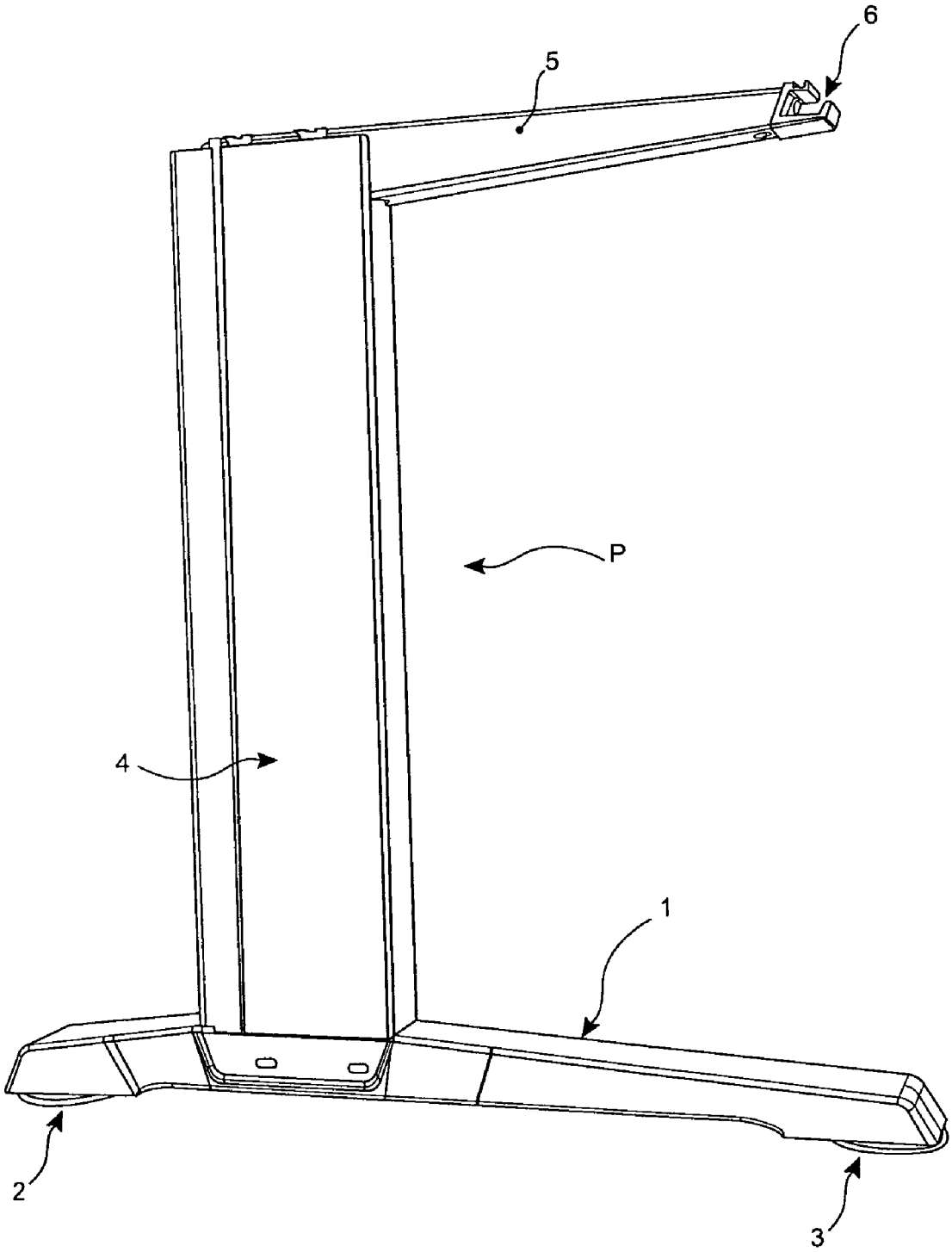
FIG. 1 is a perspective view of a desk leg assembly provided with hooking means according to the invention.

With reference to FIG. 1, the leg assembly (P) of the invention essentially includes a base (1) mounted on two actuators (2,3) and a central cylindrical shaft (4) with a vertical appearance, surmounted with a sole (5) with a horizontal appearance, the end of which includes a hook (6) according to the invention. Such leg assemblies (P) are used in the field of office furniture, for example for forming desks such as illustrated in FIG. 2.

Under this assumption, the desk consists of two rectangular horizontal platforms (7,8) supported by three leg assemblies (P, P', P"), each formed in the same way as the leg assembly (P) illustrated in FIG. 1. The front of this desk is located on the side towards which the free ends of the soles (5) are directed. Consequently, the hooks (6) which are attached to the sole at this level, are located not very far from the front border (9,10) of the platforms (7,8). The user placed in front of his/her desk, either in the sitting position or not, therefore has easy access to these hooks (6), and may hang miscellaneous articles thereon, such as his/her document-case, umbrella, etc.

Figure 2:
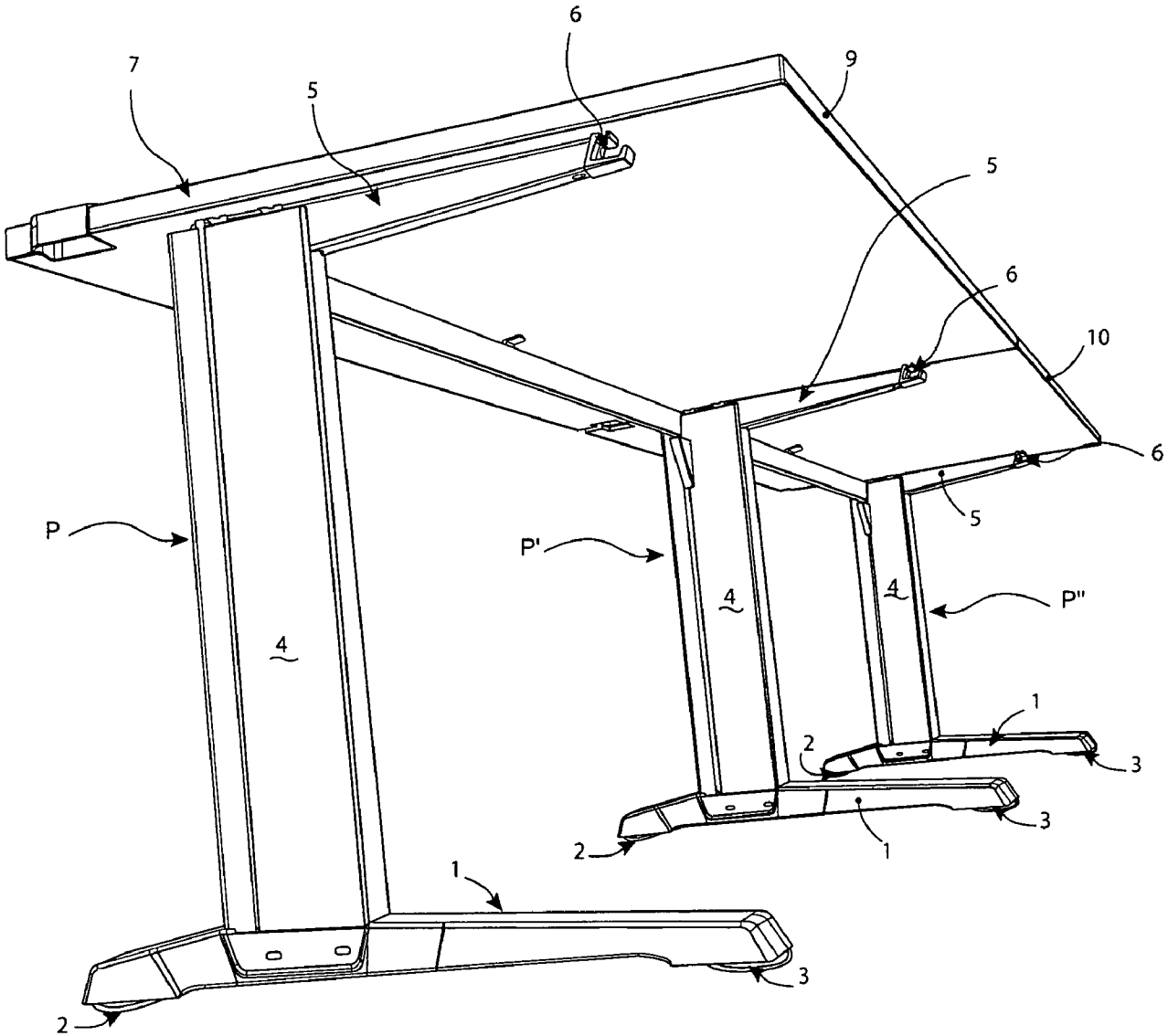
FIG. 2 shows an exemplary application of the invention with a desk layout with three leg assemblies supporting two rectangular platforms placed side by side.
Figure 3:
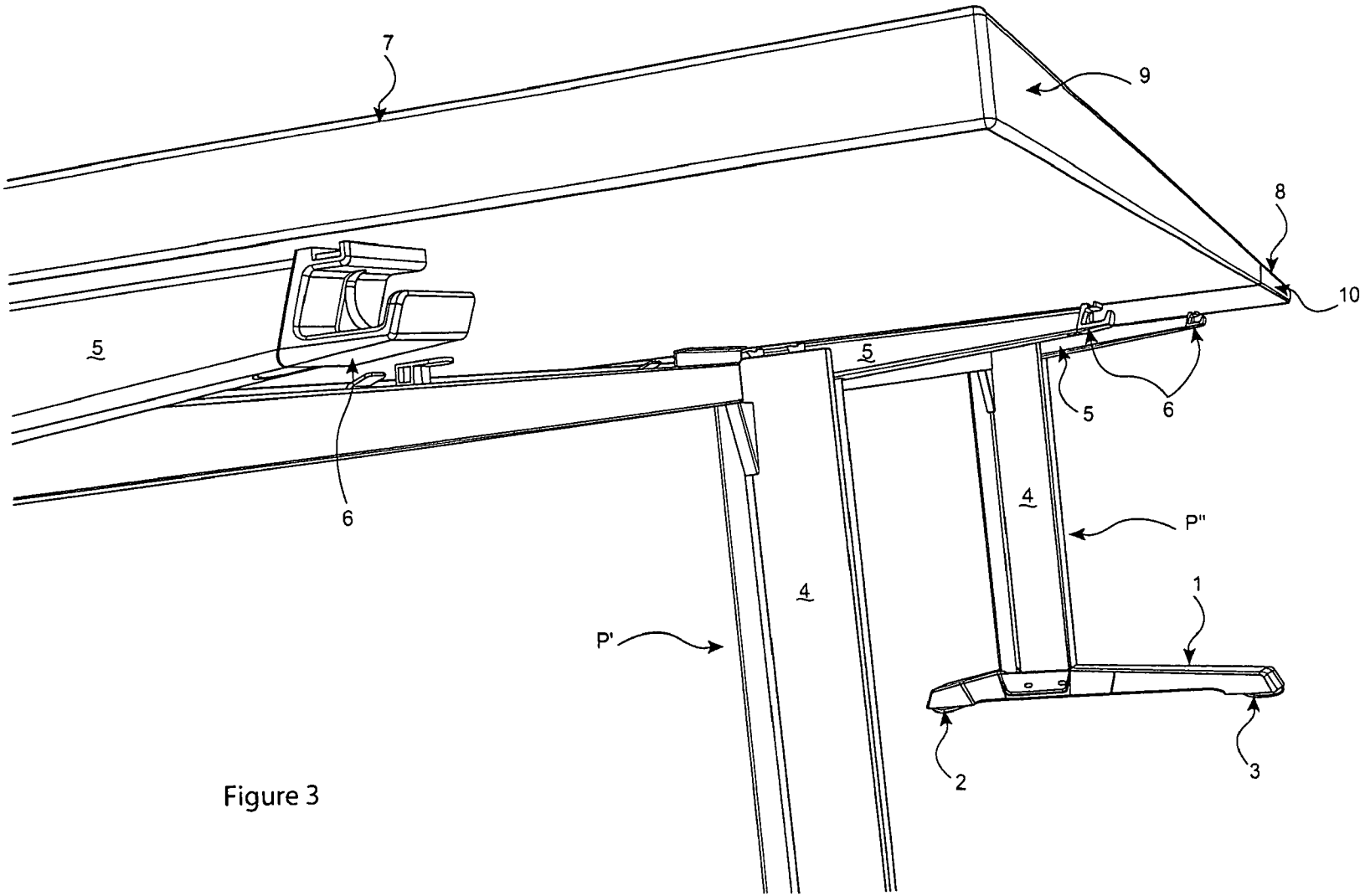
FIG. 3 illustrates an enlarged detail of FIG. 2.

FIG. 3 shows an enlargement of FIG. 2, revealing the support provided by the sole (5) and its hook (6) to the platform (7). With FIGS. 4 and 5, it is possible to more accurately visualize the connection between the free end of the sole (5) and the hook (6) on the one hand, and the structure of said hook (6) on the other hand. Thus, the hook (6) is attached to the free end of the sole (5) on one of its sides (11), which notably has a slot (12) for letting through at least one tongue (13) jutting out from the free end of the sole (5). This tongue (13) includes a protrusion (14) as a ramp allowing connection by clips. As the following figures show, there may be several tongues and therefore several ramps. These ramps (14) are tilted towards the free end of the tongues (13). The latter, being in metal sheet, are provided with sufficient elastic flexibility so that, when the ramps (14) pass into the slot (12), said tongues (13) are deformed before resuming their initial position as soon as the totality of the slot (12) is crossed by the ramp protrusion (14). This is a device for attachment by clips which is quite traditional. The slot (12) is more conspicuously visible in FIG. 5.

This provides—in the illustrated example—the passage for two tongues (13, 13') as this is apparent in FIG. 6*a*. The ramp-shaped protrusions (14, 14') are introduced into the single slot (12) until attachment by clips. They are then placed in two housings (15, 15'). These tongues (13, 13') slide on a bottom wall (16) of the housings (15, 15') parallel to the upper surface of the sole (5).

FIG. 6*a* also shows the existence of the recess (17) made on the outside of the side (11), in order to be able to position and center the sole (5) and the hook (6) facing each other. As already mentioned, the attachment by clips achieved by the ramps (14, 14') allows the hook (6) to be attached on the sole (5) in an essentially axial direction. The sliding connection of the tongues (13, 13') on the surface (16) moreover blocks both of these parts relatively to each other rotationally along an axis perpendicular to that of the sole (5).

FIG. 6*b* shows, with a tilt angle different from that of FIG. 4, the hook (6) when it is attached to the sole (5). The existence of a tab (18) separating the windows (15, 15'), performing lateral guiding of the tongues (13, 13') since it has a width substantially equal to the distance separating the ramp-shaped protrusions (14, 14'), achieves a lock against rotation around an axis parallel to the axial dimension of the sole (5).

As this notably appears in FIGS. 4-6*b*, the hook includes a lower wall with a plane appearance (19), the free end of which is terminated by a wall with a vertical appearance (20) with which the articles hung on the hook (6) may be retained. A central rib (21) allows the hook to be stiffened (6).

The example illustrated by FIGS. 1-6*b* is of course not exhaustive of the invention, which also encompasses alternative layouts and shapes within the competence of one skilled in the art.

The invention claimed is:

1. A leg assembly for a table, the leg assembly comprising:
a base provided for resting on the ground;
a substantially vertical shaft attached to the base;
an upper sole surmounting the shaft and provided for supporting a table top, the sole having an uppermost support surface, wherein
the sole has an upwardly opening hook assembly positioned at a free end of the sole; and
the hook assembly comprises a hook that extends vertically no higher than the uppermost support surface of the sole; and wherein the hook is a separate part snap-fit around the free end of the sole.

2. The leg assembly according to claim 1, wherein the hook assembly is located on an extension of the sole.

3. The leg assembly according to claim 1, wherein:
the free end of the sole extends into a recess in a side of the hook assembly;
at least one tongue extending the uppermost support surface of the sole extends into a through-slot at the top of the recess;
each tongue includes a boss with a ramp tilted towards a free end of the at least one tongue capable of elastically bending the tongue when the tongue crosses the through-slot before release when the ramp has passed the through-slot.

4. The leg assembly according to claim 3, wherein the free end of the sole includes two parallel tongues, one tab jutting out from an edge of the slot being inserted between both of the tongues and providing side guiding.

5. The leg assembly according to claim 2, wherein the hook includes a wall with a horizontal appearance terminated by a wall with a vertical appearance.

6. The leg assembly according to claim 1, wherein the leg assembly is a leg assembly for a desk.

7. A desk provided with leg assemblies according to claim 1.

8. A table including:
a leg assembly according to claim 1; and
a work surface supportable by the leg assembly;
so that when the work surface is attached to the leg assembly, the hook assembly is located in the vicinity of an edge of the work surface.

9. The table according to claim 8, wherein the table is a desk.

10. The table according to claim 8, wherein the hook is entirely under the work surface.

* * * * *